US006657610B1

(12) United States Patent
Baba

(10) Patent No.: US 6,657,610 B1
(45) Date of Patent: Dec. 2, 2003

(54) LIQUID-CRYSTAL DISPLAY DEVICE AND METHOD OF DRIVING THE SAME

(75) Inventor: Norimitsu Baba, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/700,229

(22) PCT Filed: Mar. 15, 2000

(86) PCT No.: PCT/JP00/01564

§ 371 (c)(1),
(2), (4) Date: Jan. 3, 2001

(87) PCT Pub. No.: WO00/55837

PCT Pub. Date: Sep. 21, 2000

(30) Foreign Application Priority Data

Mar. 15, 1999 (JP) ..... 11-169233

(51) Int. Cl.[7] ..... G09G 3/36
(52) U.S. Cl. ..... 345/100; 345/103
(58) Field of Search ..... 345/87, 98, 99, 345/100, 103, 204, 211; 349/33, 41, 42

(56) References Cited

U.S. PATENT DOCUMENTS 5,233,446 A * 8/1993 Inoue et al. ..... 345/87
5,353,041 A * 10/1994 Miyamoto et al. ..... 345/100
5,376,944 A * 12/1994 Mogi et al. ..... 345/100
5,475,397 A * 12/1995 Saidi ..... 345/100
5,526,015 A * 6/1996 Tsuboyama et al. ..... 345/94
5,585,815 A * 12/1996 Nakashima et al. ..... 345/100
5,815,131 A * 9/1998 Taniguchi et al. ..... 345/100
5,818,409 A * 10/1998 Furuhashi et al. ..... 345/98
5,877,738 A * 3/1999 Ito et al. ..... 345/103
6,118,425 A * 9/2000 Kudo et al. ..... 345/100

FOREIGN PATENT DOCUMENTS

| | | |
|---|---|---|
| EP | 0 585 466 | 3/1994 |
| EP | 0 598 913 | 6/1994 |
| JP | 122619 | 4/2000 |

OTHER PUBLICATIONS

T. N. Ruckmongathan, "A Generalized Addressing Technique For rMS Responding Matrix LCDs", International Display Research Conference, 1988, pp. 80–85.

* cited by examiner

*Primary Examiner*—Chanh Nguyen
*Assistant Examiner*—Paul A. Bell
(74) *Attorney, Agent, or Firm*—Michael T. Gabrik

(57) ABSTRACT

A liquid-crystal display device includes a liquid-crystal display panel having plural scanning electrodes in the form of lines and plural signal electrodes in the form of lines, a scanning signal generation section for supplying a scanning signal to each of the scanning electrodes, a data signal supply section for supplying a data signal to each of the signal electrodes, and a signal selection section. The signal selection circuit selectively controls each of the scanning electrodes so as to be capable of producing a display or so as to be incapable of producing a display. The scanning signal generation section, which is capable of generating h (h is an integer of 2 or more) types of scanning signals, supplies a scanning signal to each of the h scanning electrodes capable of producing a display at the same time in one period, and supplies the scanning signal to each of the other h scanning electrodes capable of producing a display at the same time in another period.

2 Claims, 14 Drawing Sheets

FIG. 7

| | (a) 8 LINES CHANGED TO 2 ROWS DUTY CYCLE = 1/8 | | (b) ALL ARE SELECTED DUTY CYCLE = 1/16 | | (c) 8 LINES CHANGED TO 1 ROW DUTY CYCLE = 1/8 | |
|---|---|---|---|---|---|---|
| REGISTER | COMMAND SIGNAL | LINE | COMMAND SIGNAL | LINE | COMMAND SIGNAL | LINE |
| REG1 | 0 | 0 | 1 | n | 0 | 0 |
| REG2 | 0 | 0 | 1 | n+1 | 0 | 0 |
| REG3 | 1 | n | 1 | n+2 | 0 | 0 |
| REG4 | 1 | n+1 | 1 | n+3 | 0 | 0 |
| REG5 | 1 | n+2 | 1 | n | 1 | n |
| REG6 | 1 | n+3 | 1 | n+1 | 1 | n+1 |
| REG7 | 0 | 0 | 1 | n+2 | 1 | n+2 |
| REG8 | 0 | 0 | 1 | n+3 | 1 | n+3 |
| REG9 | 0 | 0 | 1 | n | 1 | n |
| REG10 | 0 | 0 | 1 | n+1 | 1 | n+1 |
| REG11 | 1 | n | 1 | n+2 | 1 | n+2 |
| REG12 | 1 | n+1 | 1 | n+3 | 1 | n+3 |
| REG13 | 1 | n+2 | 1 | n | 0 | 0 |
| REG14 | 1 | n+3 | 1 | n+1 | 0 | 0 |
| REG15 | 0 | 0 | 1 | n+2 | 0 | 0 |
| REG16 | 0 | 0 | 1 | n+3 | 0 | 0 |

FIG. 9

FIRST SCROLLING PATTERN
"1" OF COMMAND SIGNAL IS MOVED TO SCROLL SCREEN

| REGISTER | CONTENT → | CONTENT → | CONTENT → | CONTENT → | CONTENT → | CONTENT |
|---|---|---|---|---|---|---|
| REG1 | 1 | 0 | 0 | 0 | 0 | 0 |
| REG2 | 1 | 1 | 0 | 0 | 0 | 0 |
| REG3 | 1 | 1 | 1 | 0 | 0 | 0 |
| REG4 | 1 | 1 | 1 | 1 | 0 | 0 |
| REG5 | 1 | 1 | 1 | 1 | 1 | 0 |
| REG6 | 1 | 1 | 1 | 1 | 1 | 1 |
| REG7 | 1 | 1 | 1 | 1 | 1 | 1 |
| REG8 | 1 | 1 | 1 | 1 | 1 | 1 |
| REG9 | 0 | 1 | 1 | 1 | 1 | 1 |
| REG10 | 0 | 0 | 1 | 1 | 1 | 1 |
| REG11 | 0 | 0 | 0 | 1 | 1 | 1 |
| REG12 | 0 | 0 | 0 | 0 | 1 | 1 |
| REG13 | 0 | 0 | 0 | 0 | 0 | 1 |
| REG14 | 0 | 0 | 0 | 0 | 0 | 0 |
| REG15 | 0 | 0 | 0 | 0 | 0 | 0 |
| REG16 | 0 | 0 | 0 | 0 | 0 | 0 |
| REG17 | 1 | 0 | 0 | 0 | 0 | 0 |
| REG18 | 1 | 1 | 0 | 0 | 0 | 0 |
| REG19 | 1 | 1 | 1 | 0 | 0 | 0 |
| REG20 | 1 | 1 | 1 | 1 | 0 | 0 |
| REG21 | 1 | 1 | 1 | 1 | 1 | 0 |
| REG22 | 1 | 1 | 1 | 1 | 1 | 1 |
| REG23 | 1 | 1 | 1 | 1 | 1 | 1 |
| REG24 | 1 | 1 | 1 | 1 | 1 | 1 |
| REG25 | 0 | 1 | 1 | 1 | 1 | 1 |
| REG26 | 0 | 0 | 1 | 1 | 1 | 1 |
| REG27 | 0 | 0 | 0 | 1 | 1 | 1 |
| REG28 | 0 | 0 | 0 | 0 | 1 | 1 |
| REG29 | 0 | 0 | 0 | 0 | 0 | 1 |
| REG30 | 0 | 0 | 0 | 0 | 0 | 0 |
| REG31 | 0 | 0 | 0 | 0 | 0 | 0 |
| REG32 | 0 | 0 | 0 | 0 | 0 | 0 |

FIG. 10

SECOND SCROLLING PATTERN
"1" OF COMMAND SIGNAL IS MOVED TO PARTIALLY SCROLL SCREEN

| REGISTER | CONTENT → | CONTENT → | CONTENT → | CONTENT → | CONTENT → | CONTENT |
|---|---|---|---|---|---|---|
| REG1 | 1 | 1 | 1 | 1 | 1 | 1 |
| REG2 | 1 | 1 | 1 | 1 | 1 | 1 |
| REG3 | 1 | 1 | 1 | 1 | 1 | 1 |
| REG4 | 1 | 1 | 1 | 1 | 1 | 1 |
| REG5 | 1 | 1 | 1 | 1 | 1 | 1 |
| REG6 | 1 | 1 | 1 | 1 | 1 | 1 |
| REG7 | 1 | 1 | 1 | 1 | 1 | 1 |
| REG8 | 1 | 1 | 1 | 1 | 1 | 1 |
| REG9 | 0 | 0 | 0 | 0 | 0 | 0 |
| REG10 | 0 | 0 | 0 | 0 | 0 | 0 |
| REG11 | 0 | 0 | 0 | 0 | 0 | 0 |
| REG12 | 0 | 0 | 0 | 0 | 0 | 0 |
| REG13 | 0 | 0 | 0 | 0 | 0 | 0 |
| REG14 | 0 | 0 | 0 | 0 | 0 | 0 |
| REG15 | 0 | 0 | 0 | 0 | 0 | 0 |
| REG16 | 0 | 0 | 0 | 0 | 0 | 0 |
| REG17 | 1 | 0 | 0 | 0 | 0 | 0 |
| REG18 | 1 | 1 | 0 | 0 | 0 | 0 |
| REG19 | 1 | 1 | 1 | 0 | 0 | 0 |
| REG20 | 1 | 1 | 1 | 1 | 0 | 0 |
| REG21 | 1 | 1 | 1 | 1 | 1 | 0 |
| REG22 | 1 | 1 | 1 | 1 | 1 | 1 |
| REG23 | 1 | 1 | 1 | 1 | 1 | 1 |
| REG24 | 1 | 1 | 1 | 1 | 1 | 1 |
| REG25 | 0 | 1 | 1 | 1 | 1 | 1 |
| REG26 | 0 | 0 | 1 | 1 | 1 | 1 |
| REG27 | 0 | 0 | 0 | 1 | 1 | 1 |
| REG28 | 0 | 0 | 0 | 0 | 1 | 1 |
| REG29 | 0 | 0 | 0 | 0 | 0 | 1 |
| REG30 | 0 | 0 | 0 | 0 | 0 | 0 |
| REG31 | 0 | 0 | 0 | 0 | 0 | 0 |
| REG32 | 0 | 0 | 0 | 0 | 0 | 0 |

LIQUID-CRYSTAL DISPLAY DEVICE AND METHOD OF DRIVING THE SAME

TECHNICAL FIELD

The present invention relates to a liquid-crystal display device which is suitably used particularly in a method of selecting plural scanning electrodes in the form of lines at the same time and driving them, and to a method of driving the same.

BACKGROUND ART

Generally, since liquid-crystal display devices have features, such as small size and low profile, low power consumption, and flat-panel display, they are widely used in display portions of wristwatches, portable game machines, notebook-type personal computers, liquid-crystal televisions, car navigation devices, and other electronic devices.

As methods of driving a liquid-crystal display panel, there are a driving method of selecting scanning electrodes one at a time and driving them, and an MLS (multi-line selection) driving method (refer to International Application Publication No. WO93/18501) in which all scanning electrodes are grouped in advance and a scanning signal is simultaneously output to plural adjacent scanning electrodes belonging to the same group in a predetermined period. The MLS driving method has an advantage in that power consumption can be reduced.

An example of a conventional liquid-crystal display device using an MLS driving method will now be described with reference to FIGS. 11 to 13. As shown in FIG. 11, a conventional liquid-crystal display device 100 has a liquid-crystal display panel 101. As shown in FIG. 12, the liquid-crystal display panel 101 has a substrate having plural scanning electrodes (common electrodes) Y (Y1, Y2, . . . Ym) in the form of lines, a substrate having plural signal electrodes (segment electrodes) X (X1, X2, . . . Xn) in the form of lines, and a liquid-crystal layer (not shown) interposed between the two substrates. In order to drive the liquid-crystal display panel 101, a liquid-crystal driving circuit 102 supplies, to each scanning electrode Y, a scanning signal which can differ according to each scanning electrode and supplies, to each signal electrode X, a data signal which can differ according to each signal electrode. A liquid-crystal driving voltage generation circuit 103, which is connected to an input end of the liquid-crystal driving circuit 102, generates a liquid-crystal driving voltage. A driving control circuit 104 is connected to the input ends of the liquid-crystal driving circuit 102 and the liquid-crystal driving voltage generation circuit 103. When the driving control circuit 104 receives display data and control data, the driving control circuit 104 generates a display signal and supplies it to the liquid-crystal driving circuit 102 and the liquid-crystal driving voltage generation circuit 103.

The liquid-crystal driving circuit 102 comprises a driving circuit 105 on the scanning side which generates a scanning signal which is output to a scanning electrode Y of the liquid-crystal display panel 101 and a driving circuit 106 on the signal side which generates a data signal which is output to a signal electrode X thereof when the liquid-crystal driving voltage and the display signal are received.

Next, the driving operation of the liquid-crystal display device 100 is described with reference to FIGS. 12 and 13. In this technique, the scanning electrodes Y are grouped in advance so that plural (3 in the example of the figures) adjacent scanning electrodes belong to the same group. The driving circuit 105 on the scanning side drives three scanning electrodes Y belonging to the same group at the same time. That is, the driving circuit 105 on the scanning side generates a scanning signal corresponding to each of the three scanning electrodes Y in a predetermined horizontal scanning period T. Then, another group is driven at the same time, and the process proceeds to the driving of another group in sequence. On the other hand, the driving circuit 106 on the signal side generates a data signal corresponding to each one of the signal electrodes X1, X2, . . . Xn.

Specifically, as shown in part (a) of FIG. 13, the three scanning electrodes Y1, Y2, and Y3 of the first group are selected in the first horizontal scanning period T, scanning signals are applied to these scanning electrodes Y1, Y2, and Y3, and at the same time, data signals are applied to the signal electrodes X. As shown in FIG. 13, the scanning signal and the data signal can change in an interval of a selection period Δt even within the same horizontal scanning period T. In the next horizontal scanning period T, as shown in part (b) of FIG. 13, the scanning electrodes Y4, Y5, and Y6 of the next group are selected, and scanning signals having a waveform similar to that supplied to the scanning electrodes Y1, Y2, and Y3 are applied to those electrodes. The application of the data signals to the signal electrodes X is performed continuously from the previous horizontal scanning period T, and the waveform is different from the previous one. In this manner, the process proceeds to the driving of the next group, and when the driving of the final group is terminated, the process returns to the driving of the first group. The period of time required for the driving of all the scanning electrode groups to be completed once, that is, the period of time required to scan one display area of the liquid-crystal display panel 101 once, is called "one frame" (as indicated by F in FIG. 13).

Since the voltage level of the scanning signal exists at two levels, +V2 and −V2, if the number of scanning electrodes Y belonging to one group (the number of scanning electrodes which are selected at one time) is denoted as h, the number of pulse patterns which can be realized by one group in one selection period Δt is $2^h$. That is, for example, as shown in FIG. 13, in a case where three scanning electrodes Y are selected at the same time, the number of pulse patterns which can be realized by one group in one selection period Δt is $2^3=8$. In the first selection period Δt in the first horizontal scanning period T, the scanning electrode Y1 is off (voltage=−V2), the scanning electrode Y2 is off, and the scanning electrode Y3 is off. In the next selection period Δt, the scanning electrode Y1 is off, the scanning electrode Y2 is off, and the scanning electrode Y3 is on (voltage=+V2), and in sequence, a different pulse pattern is used in each selection period Δt.

The data signal applied to each signal electrode X is determined by the on/off of each of the pixels (3 pixels in the case of 3-line simultaneous driving) which are objects for display at the same time on that signal electrode, and the voltage level of the scanning signal applied to the scanning electrode Y. For example, in this conventional technique, during the period in which the voltage of a pulse of a scanning signal applied to the scanning electrodes Y1, Y2, and Y3 which are selected at the same time is positive, the pixel display is assumed to be on; during the period in which the voltage of the pulse is negative, the pixel display is assumed to be off; and the on/off of the display data is compared with the voltage level of the scanning signal at each selection period Δt, so that the data signal is set according to the number of mismatches.

Specifically, in the waveforms of the scanning signals sent to the scanning electrodes Y1, Y2, and Y3 in part (a) of FIG. 13, during the period in which a voltage of +V2 is applied, the pixel display is assumed to be on; during the period in which a voltage of −V2 is applied, the pixel display is assumed to be off; a pixel in FIG. 12 whose display is indicated as a black circle mark is assumed to be on, and a pixel whose display is indicated as a white circle mark is assumed to be off. The displays of the pixels at which the signal electrode X1 intersects the scanning electrodes Y1, Y2, and Y3 in FIG. 12 are on, on, and off, in that order. It is assumed that data signals for obtaining such pixel displays are supplied. In contrast, the voltages applied to the scanning electrodes Y1, Y2, and Y3 in the first selection period Δt indicate off, off, and off, respectively. Then, when both of the voltages of the display data and of the scanning signals are compared with each other in sequence, the number of mismatches is 2. Therefore, in the first selection period Δt, a voltage V1 is applied to the signal electrode X1, as shown in part (c) of FIG. 13. In the technique shown in FIG. 13, when the number of mismatches is 0, a pulse voltage of −V2 is applied to the signal electrode X; when the number of mismatches is 1, a pulse voltage of −V1 is applied thereto; when the number of mismatches is 2, a pulse voltage of V1 is applied thereto; and when the number of mismatches is 3, a pulse voltage of V2 is applied thereto. The voltage ratio of V1 and V2 is set so as to satisfy V1:V2=1:2.

In the next selection period Δt, the voltages applied to the scanning electrodes Y1, Y2, and Y3 indicate off, off, and on, respectively. When these are compared with the on, on, and off displays of the pixels in sequence, all the voltage levels of the scanning signals do not match, and the number of mismatches is 3. Therefore, a pulse voltage V2 is applied to the signal electrode X1 in this selection period Δt. In a similar manner, in the third selection period Δt, V1 is applied to the signal electrode X1 at the third selection period Δt, and −V1 is applied thereto in the fourth selection period Δt. Hereafter, voltages are applied in the sequence of −V2, +V1, −V1, and −V1.

Furthermore, in the next horizontal scanning period T, the scanning electrodes Y4 to Y6 of the next group are selected. When voltages having waveforms shown in part (b) of FIG. 13 are added to these scanning electrodes Y4 to Y6, a data signal of a voltage level corresponding to the mismatch between the on/off display of the pixels at which the scanning electrodes Y4 to Y6 intersect the signal electrodes and the on/off of the voltage levels of the scanning signals applied to the scanning electrodes Y4 to Y6 is applied to the signal electrode X1, as shown in part (c) of FIG. 13. Part (d) of FIG. 13 shows a waveform indicating a voltage applied to the pixel at which the scanning electrode Y1 intersects the signal electrode X1, that is, a combined waveform of the scanning signal applied to the scanning electrode Y1 and the data signal applied to the signal electrode X1.

As described above, in the MLS driving method for selecting plural scanning electrodes at the same time in sequence and driving them, satisfactory contrast can be obtained, and furthermore, the driving voltage can be reduced.

In the liquid-crystal display device 100 using the MLS driving method according to the above-described conventional art, the on/off of display pixels is controlled by a combination of waveforms of a scanning signal supplied to the scanning electrode Y and a data signal supplied to the signal electrode X. For this reason, since it is necessary to set waveforms to be supplied to both of the electrodes in advance, it is difficult to diversify display modes irrespective of how the scanning electrodes are grouped.

For example, regarding the size of font to be used, in the case of 3-line MLS for selecting three scanning electrodes at the same time, grouping into a multiple of 3, such as 3 pixels, 6 pixels, or 9 pixels, in the vertical direction is easy. However, selection of other numbers of pixels causes signal control to be complex.

Furthermore, partial driving in which the screen of the liquid-crystal display panel 101 is divided into display areas and non-display areas is often performed to reduce power consumption. Here, in the conventional MLS driving method, since plural scanning electrodes belonging to the same group are always driven simultaneously, the width of the display area is completely limited by grouping. For example, if three scanning electrodes are driven at the same time, the display area can have only a width corresponding to lines of a multiple of 3. This applies similarly to multi-row display, in which plural display areas are provided, in partial driving.

DISCLOSURE OF THE INVENTION

The present invention provides a liquid-crystal display device employing an MLS driving method capable of realizing various displays, and a method of driving the same.

According to one aspect of the present invention, the liquid-crystal display device comprises:

- a liquid-crystal display panel having a substrate having plural scanning electrodes in the form of lines, a substrate having plural signal electrodes in the form of lines, and a liquid-crystal layer interposed between the substrates;
- a scanning signal generation section which is capable of generating h (h is an integer of 2 or more) types of scanning signals, which supplies the scanning signal to each of the h scanning electrodes at the same time in one period, and which supplies the scanning signal to each of the h scanning electrodes at the same time in another period;
- a data signal supply section for supplying a data signal to each of the signal electrodes;
- a signal selection section for selectively controlling each of the scanning electrodes so as to be capable of producing a display or so as to be incapable of producing a display; and
- a control section for controlling the scanning signal generation section in such a way that the scanning signal generation section supplies the scanning signal to the scanning electrode which is controlled by the signal selection section so as to be capable of producing a display.

The signal selection section may comprise plural registers for storing data for causing each of the scanning electrodes to be capable of producing a display or to be incapable of producing a display.

A scroll control section for controlling the signal selection section may be provided so that the electrode which is capable of producing a display and the electrode which is incapable of producing a display are made to shift as time elapses.

According to one aspect of the present invention, the method of driving a liquid-crystal display device comprising a liquid-crystal display panel having a substrate having plural scanning electrodes in the form of lines, a substrate having plural signal electrodes in the form of lines, and a liquid-crystal layer interposed between the substrates, the method comprising the steps of:

- generating h (h is an integer of 2 or more) types of scanning signals, supplying the scanning signal to each of the h scanning electrodes at the same time in one period, and supplying the scanning signal to each of the h scanning electrodes at the same time in another period; supplying a data signal to each of the signal electrodes;

selectively controlling each of the scanning electrodes so as to be capable of producing a display or so as to be incapable of producing a display; and controlling the scanning signal generation section in such a way that the scanning signal generation section supplies the scanning signal to the scanning electrode which is controlled by the signal selection section so as to be capable of producing a display.

BRIEF DESCRIPTION OF THE DRAWINGS

FIG. 7 is a table for illustrating various display modes which can be realized by the liquid-crystal display device.

FIG. 9 is a table for illustrating an example of a screen scrolling pattern for causing the liquid-crystal display panel in FIG. 1 to be partially driven and to perform screen scrolling.

FIG. 10 is a table for illustrating another example of a screen scrolling pattern for causing the liquid-crystal display panel in FIG. 1 to be partially driven and to perform screen scrolling.

BEST MODE FOR CARRYING OUT THE INVENTION

An embodiment of the present invention will be described below with reference to FIGS. 1 to 10. In this embodiment, an MLS driving method of 4-line simultaneous driving in which four scanning electrodes are driven simultaneously is adopted, but it is not intended that the present invention be limited to this embodiment.

Figure 1:
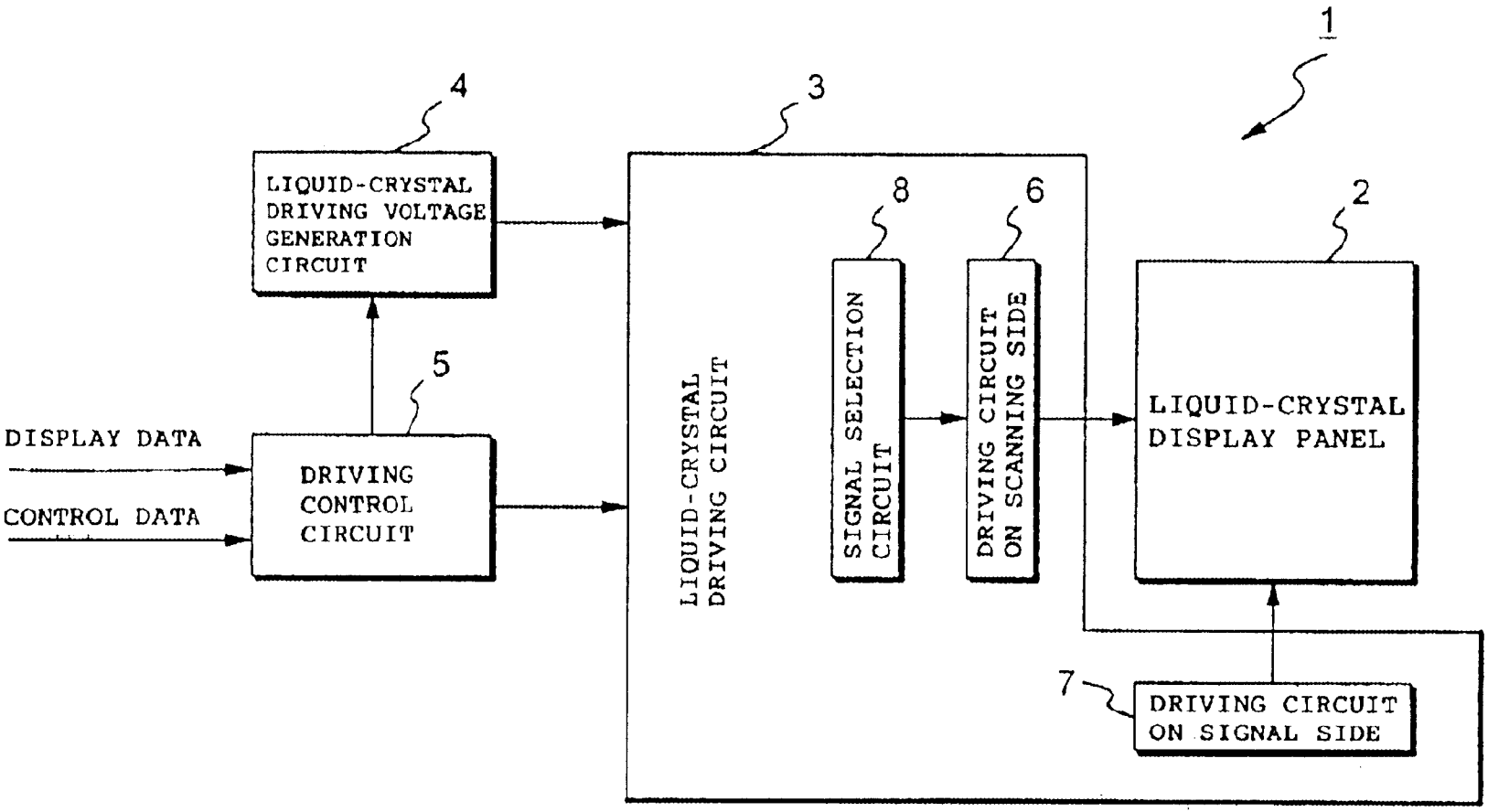
FIG. 1 is a block diagram showing the entire construction of a liquid-crystal display device according to an embodiment of the present invention.
Figure 1A:
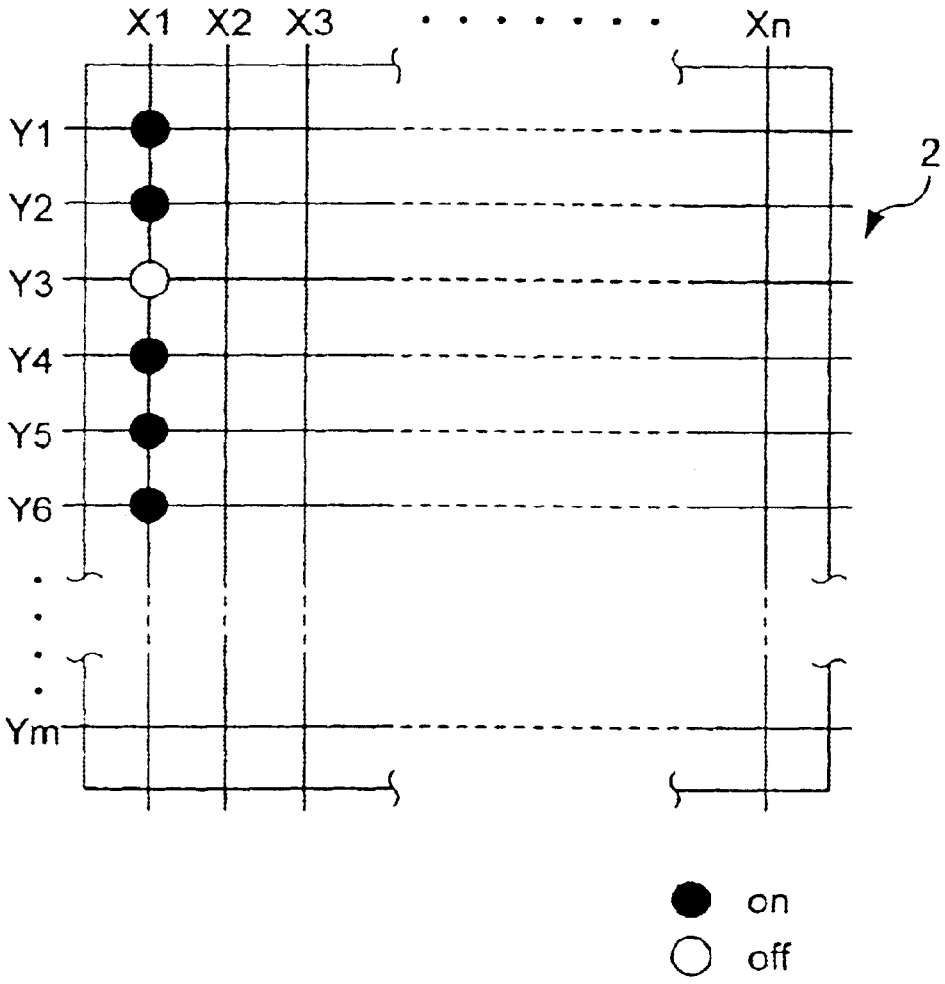
FIG. 1A is a plan view showing a liquid-crystal display panel of the liquid-crystal display device of FIG. 1.
Figure 1B:
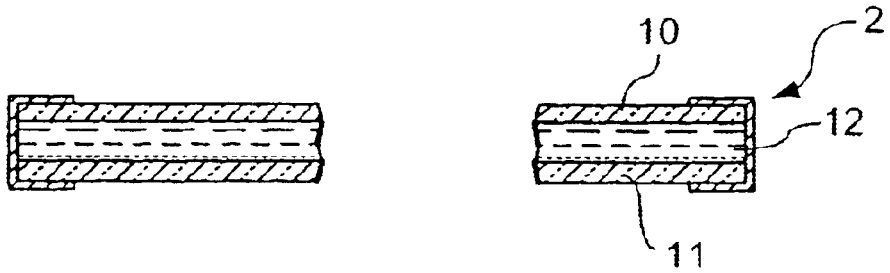
FIG. 1B is a side view of the liquid-crystal display panel of FIG. 1A.

As shown in FIG. 1, a liquid-crystal display device 1 according to the embodiment of the present invention comprises a liquid-crystal display panel 2, a liquid-crystal driving circuit 3, a liquid-crystal driving voltage generation circuit 4, and a driving control circuit 5. As shown in FIG. 1A, the liquid-crystal display panel 2 has plural scanning electrodes (common electrodes) Y (Y1, Y2, . . . Ym) in the form of lines, and plural signal electrodes (segment electrodes) X (X1, X2, . . . Xn) in the form of lines intersecting at right angles to these scanning electrodes in plan view. As shown in FIG. 1B, the liquid-crystal display panel 2 has a transparent or translucent substrate 10 on which the scanning electrodes Y are formed, a transparent or translucent substrate 11 on which the signal electrodes X are formed, and a liquid-crystal layer 12 interposed between the two substrates 10 and 11.

For example, the number m of scanning electrodes is 64, and the number n of signal electrodes is 96. In order to drive the liquid-crystal display panel 2, the liquid-crystal driving circuit 3 supplies, to each scanning electrode Y, a scanning signal which can differ according to each of the scanning electrodes and supplies, to each signal electrode X, a data signal which can differ according to each of the signal electrodes. The liquid-crystal driving voltage generation circuit 4, which is connected to an input end of the liquid-crystal driving circuit 3, generates a liquid-crystal driving voltage. The driving control circuit 5 is connected to the input ends of the liquid-crystal driving circuit 3 and the liquid-crystal driving voltage generation circuit 4. When the driving control circuit 5 receives display data and control data, the driving control circuit 5 generates a display signal and supplies it to the liquid-crystal driving circuit 3 and the liquid-crystal driving voltage generation circuit 4.

The liquid-crystal driving circuit 3 comprises a driving circuit 6 on the scanning side as a scanning signal generation circuit connected to all the scanning electrodes Y1, Y2, . . . Ym of the liquid-crystal display panel 2, and a driving circuit 7 on the signal side as a data signal generation circuit connected to all the signal electrodes XI, X2, . . . Xn. The scanning electrodes Y are grouped in advance so that four adjacent scanning electrodes belong to the same group. The driving circuit 6 on the scanning side drives four scanning electrodes Y belonging to the same group. That is, the driving circuit 6 on the scanning side generates a scanning signal corresponding to each of the four scanning electrodes Y in a predetermined selection period t1. On the other hand, the driving circuit 7 on the signal side generates a data signal corresponding to each one of the signal electrodes X1, X2, . . . Xn.

A signal selection circuit 8 for regulating an output of a scanning signal from the driving circuit 6 on the scanning side to the scanning electrodes Y is connected to the driving circuit 6 on the scanning side. The signal selection circuit 8 functions as a signal selection circuit for selecting which scanning signal should be effectively supplied to a corresponding scanning electrode Y. In FIG. 1, the signal selection circuit 8 is shown as being separate and independent of the driving circuit 6 on the scanning side, but the driving circuit 6 on the scanning side may instead contain the signal selection circuit 8. For example, if the signal selection circuit 8 is housed, within one device, together with the driving circuit 6 on the scanning side and the driving circuit 7 on the signal side, the size of the liquid-crystal display device 1 can be reduced.

Figure 2:
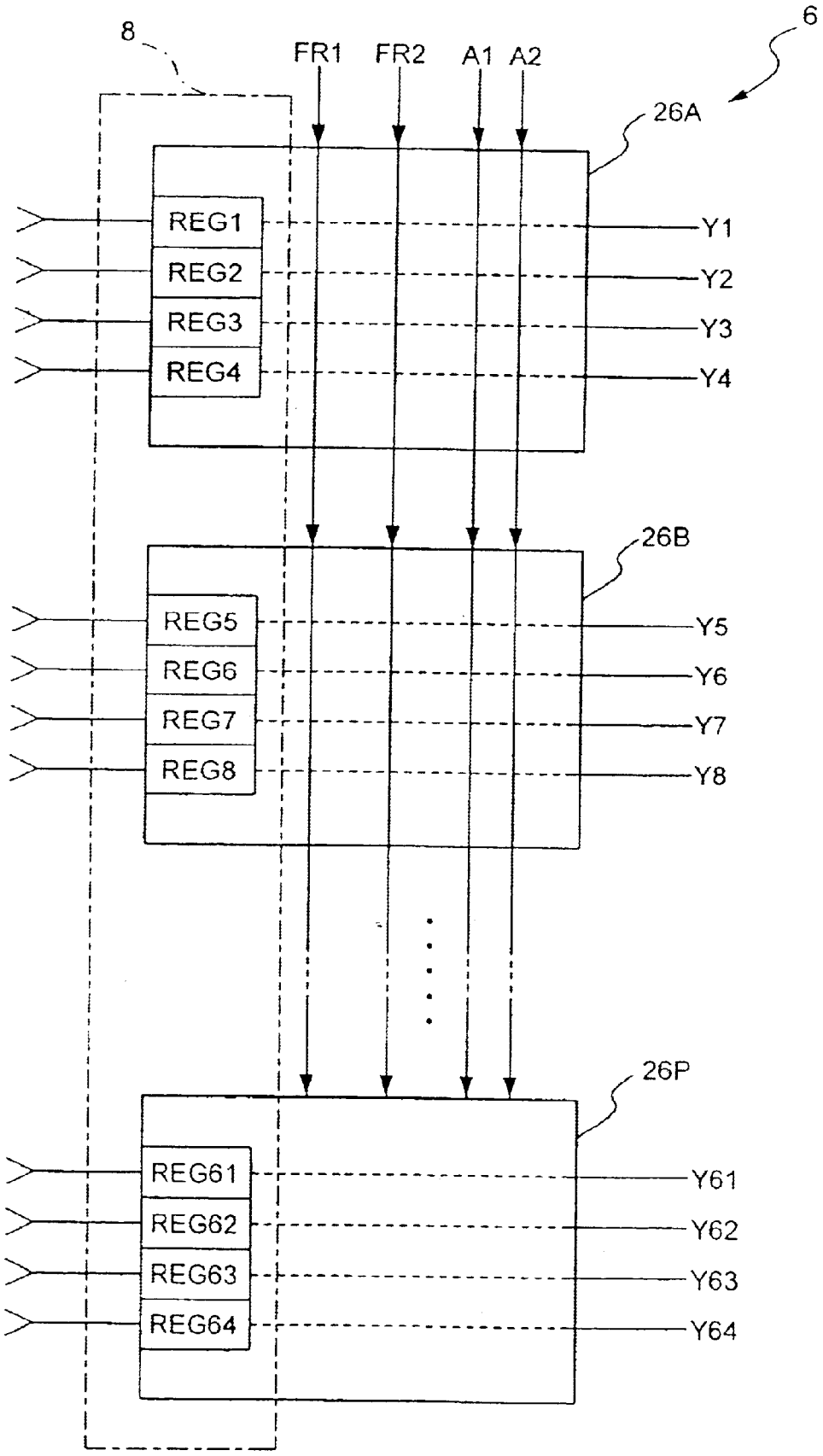
FIG. 2 is a block diagram showing details of a driving circuit on the scanning side and a signal selection circuit in FIG. 1.

As shown in FIG. 2, in this embodiment, the driving circuit 6 on the scanning side comprises 16 circuit sections 26 (26A, 26B, . . . 26P). These circuit sections 26A, 26B, . . . 26P correspond to 16 groups of the scanning electrodes, respectively, and four scanning electrodes Y belong to each group. That is, scanning electrodes Y1 to Y4 of the liquid-crystal display panel 2 are connected to an output end of the circuit section 26A, and scanning electrodes Y5 to Y8 thereof are connected to an output end of the circuit section 26B. In a similar manner, scanning electrodes Y61 to Y64 thereof are connected to the circuit section 26P.

The signal selection circuit 8 comprises 64 registers REG1 to REG64 corresponding to all the scanning electrodes Y1, Y2, . . . Ym, respectively. The content of each of the registers REG1 to REG64 is set to "1" or "0" based on the control of the driving control circuit 5, and each of the registers REG1 to REG64 regulates the output of the scanning electrode to a corresponding circuit section 26 according to the setting. That is, in a case where a command signal indicating "1" is input to one of the registers REG1 to REG64, that register REG outputs a scanning signal to a corresponding scanning electrode Y so that this scanning electrode Y contributes to the display of the liquid-crystal display panel 2. Scanning electrodes which can contribute to such display of the liquid-crystal display panel 2 are hereinafter called "display electrodes". On the other hand, in a case where a command signal indicating "0" is input thereto, the register REG causes a scanning signal to a corresponding scanning electrode Y to be at a zero potential (substantially stopping output of the scanning signal) so that this scanning electrode Y does not contribute to the display of the liquid-crystal display panel 2. Electrodes which do not contribute to such display thereof are hereinafter called "non-display electrodes".

As a result of grouping the scanning electrodes Y1, Y2, . . . Ym of the liquid-crystal display device 1 into display electrodes and non-display electrodes under the control of the signal selection circuit 8 having the registers REG1 to REG64, display areas and non-display areas exist in the liquid-crystal display device 1 according to this embodiment. This state is called "partial driving". In this embodiment, it is possible to group Y1, Y2, . . . Ym into display electrodes and non-display electrodes irrespective of the grouping of the scanning electrodes.

Figure 4:
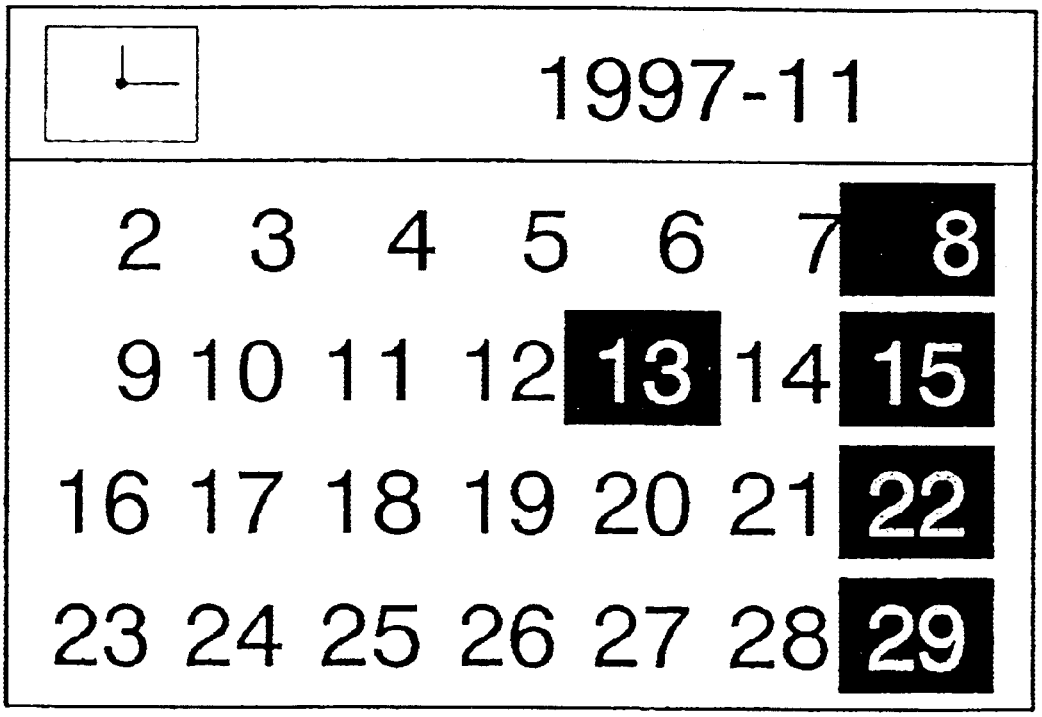
FIG. 4 is a front view showing the screen of the liquid-crystal display panel in FIG. 1, in which entire screen driving is being performed.
Figure 6:
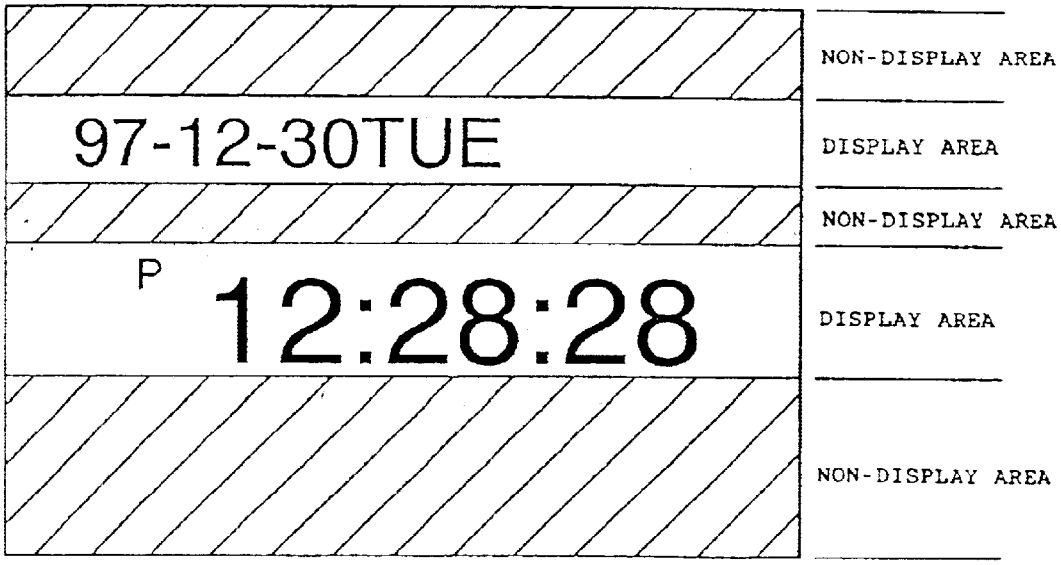
FIG. 6 is a front view showing the screen of the liquid-crystal display panel, in which partial driving is being performed.

FIG. 6 shows the screen of the liquid-crystal display panel 2 in which partial driving is being performed. In FIG. 6, the diagonal shading indicates non-display areas. On the other hand, FIG. 4 shows the screen of the liquid-crystal display panel 2 in which entire screen driving is being performed.

The driving control circuit 5 determines whether entire screen driving should be performed or partial driving should be performed on the liquid-crystal display panel 2 on the basis of control data. When partial driving should be performed, the driving control circuit 5 further determines which scanning electrodes Y should be set as display electrodes. Based on the determination, the driving control circuit 5 supplies each command signal indicating "1" or "0" to the registers REG1 to REG64 of the signal selection circuit 8. Whereas in the entire screen driving, a command signal indicating "1" is supplied to all the registers REG1 to REG64, in the partial driving, a command signal indicating "1" is supplied to registers corresponding to the display electrodes and a command signal indicating "0" is supplied to the registers corresponding to the non-display electrodes.

Figure 3:
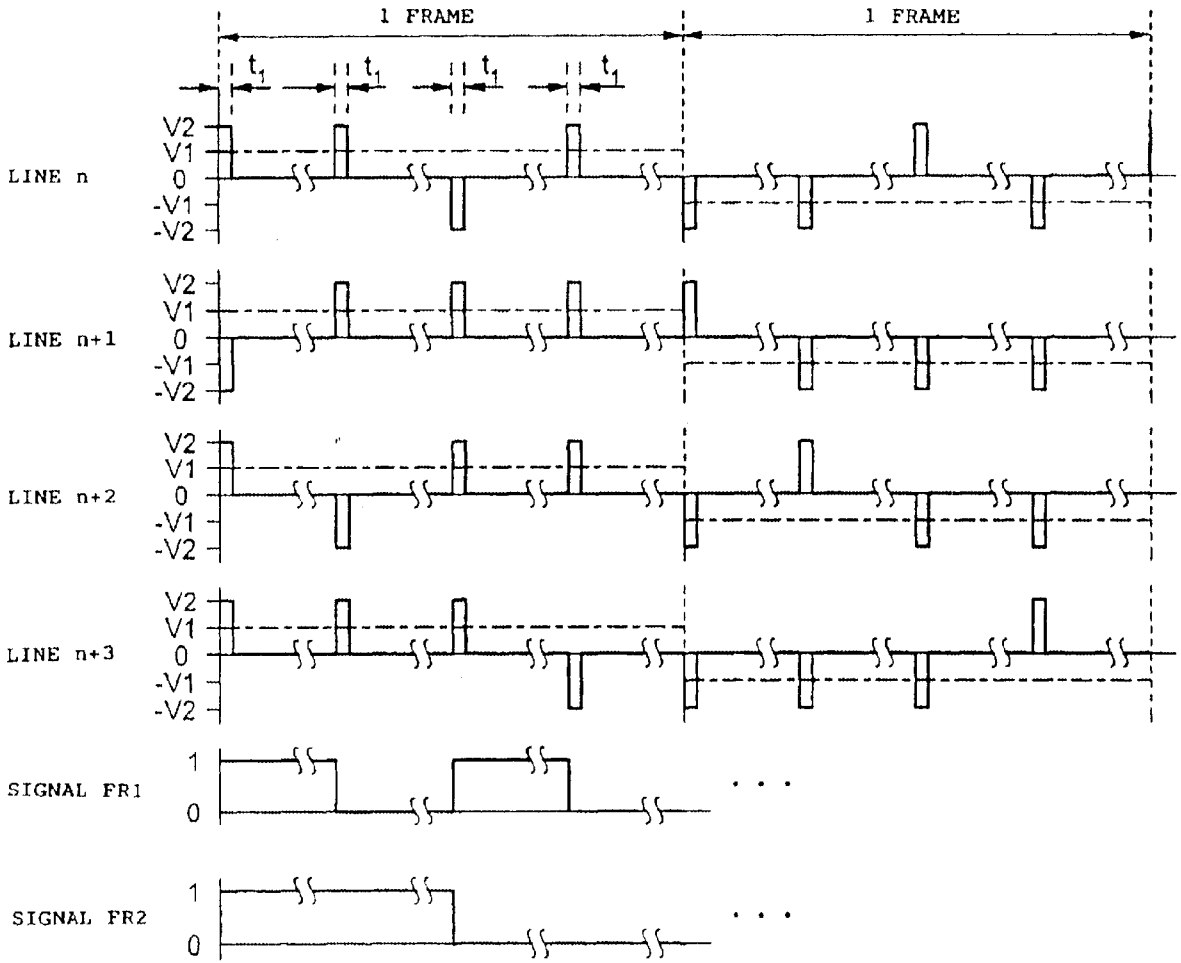
FIG. 3 is a diagram showing waveforms of scanning signals supplied to scanning electrodes when the liquid-crystal display panel in FIG. 1 is driven for the entire screen.

FIG. 3 shows examples of outputs of scanning signals in a case where all the scanning electrodes Y1, Y2, . . . Ym are set to be display electrodes (in the case of the entire screen driving). In FIG. 3, references n to n+3 are numbers which are given to scanning electrodes Y which contribute to display. In the case of entire screen driving, the relationships between the scanning electrodes Y1, Y2, . . . Ym and lines n to n+3 are as shown in Table 1.

TABLE 1

| | |
|---|---|
| Line n | Scanning electrodes Y1, Y5, Y9, . . . Y61<br>(Suffix is a number with a remainder of 1 when divided by 4) |
| Line n + 1 | Scanning electrodes Y2, Y6, Y10, . . . Y62<br>(Suffix is a number with a remainder of 2 when divided by 4) |
| Line n + 2 | Scanning electrodes Y3, Y7, Y11, . . . Y63<br>(Suffix is a number with a remainder of 3 when divided by 4) |
| Line n + 3 | Scanning electrodes Y4, Y8, Y12, . . . Y64<br>(Suffix is a number which is divisible by 4) |

As shown in FIG. 3, four scanning electrode lines n to n+3 belonging to one group are simultaneously driven in four selection periods t1 in one frame. However, the voltage levels output by the lines n to n+3 in each selection period t1 differ from one another. Since the voltage level of the scanning signal exists at two levels, +V2 and −V2, in this embodiment in which four scanning electrode lines are driven simultaneously, the number of pulse patterns which can be realized by one group in one selection period t1 is $2^4$=16. In order to control the voltage levels of the lines n to n+3 according to each selection period t1 in this manner, signals FR1 and FR2 are supplied from the driving control circuit 5 shown in FIG. 1 to the circuit sections 26A to 26P of the driving circuit 6 on the scanning side. In the selection period t1, each of the circuit sections 26A to 26P controls, based on the signals FR1 and FR2, the voltage levels to be output to the lines n to n+3, for example, in accordance with the rules in Table 2. Table 2 shows the relationships between the values of the signals FR1 and FR2 and the voltage levels output from the lines n to n+3.

TABLE 2

| | | | | |
|---|---|---|---|---|
| Signal FR1 | 1 | 0 | 1 | 0 |
| Signal FR2 | 1 | 1 | 0 | 0 |
| Line n | V2 | V2 | −V2 | V2 |
| Line n + 1 | −V2 | V2 | V2 | V2 |
| Line n + 2 | V2 | −V2 | V2 | V2 |
| Line n + 3 | V2 | V2 | V2 | −V2 |

As shown in Table 2 and in FIG. 3, in the first selection period t1 in one frame, the signals FR1 and FR2 are at a high level (1), and whereas a voltage V2 is supplied to the lines n, n+2, and n+3, a voltage −V2 is supplied to the line n+1. In the next selection period t1, the signal FR1 is at a high level, but the signal FR2 is at a low level (0), and whereas a voltage V2 is supplied to the lines n, n+1, and n+3, a voltage −V2 is supplied to the line n+2. That is, the voltage level state of each line, given in one selection period t1, differs from the voltage level state in another selection period t1.

TABLE 3

| | Registers | Command signals | Signal electrodes X |
|---|---|---|---|
| Circuit section 26A | REG1 | 0 | — |
| | REG2 | 0 | — |
| | REG3 | 1 | Line n |
| | REG4 | 1 | Line n + 1 |

TABLE 3-continued

| | Registers | Command signals | Signal electrodes X |
|---|---|---|---|
| Circuit section 26B | REG5 | 1 | Line n + 2 |
| | REG6 | 1 | Line n + 3 |
| | REG7 | 0 | — |
| | REG8 | 0 | — |
| Circuit section 26C | REG9 | 0 | — |
| | REG10 | 1 | Line n |
| | REG11 | 0 | — |
| | REG12 | 1 | Line n + 1 |
| Circuit section 26D | REG13 | 1 | Line n + 2 |
| | REG14 | 1 | Line n + 3 |
| | REG15 | 0 | — |
| | REG16 | 1 | Line n |
| Circuit section 26E | REG17 | 1 | — |
| . | . | . | . |
| . | . | . | . |
| . | . | . | . |

Next, partial driving is described in which some electrodes are set as non-display electrodes as a result of setting each command signal to the registers REG1 to REG64. In this embodiment, since it is possible to group Y1, Y2, . . . Ym into display electrodes and non-display electrodes irrespective of the grouping of the scanning electrodes, the relative relationships between the scanning electrodes Y1, Y2, . . . Ym in the partial driving and the lines n to n+3 differ from the above-described relative relationships in the entire screen driving. For example, in a case where command signal groups such as those shown in Table 3 are input to the registers REG1 to REG64, the third scanning electrode Y3 is at line n, and the fourth scanning electrode Y4 is at line n+1.

As described above, in this embodiment, in the partial driving, which of the scanning electrodes Y1, Y2, . . . Ym the lines n to n+3 correspond to, respectively, is not determined in advance. This relative relationship is determined by the driving control circuit 5 (refer to FIG. 1). After the driving control circuit 5 determines which scanning electrodes Y should be set as display electrodes, the driving control circuit 5 supplies signals A1 and A2 as line information to all the circuit sections 26A to 26P. Each of the signals A1 and A2 indicates "0" or "1", and a pair of signals A1 and A2 represent 2-bit information. All the display electrodes are assigned a pair of signals A1 and A2, and each combination of the signals A1 and A2 represents one of the lines n to n+3, as shown in Table 4.

TABLE 4

| | Signal A1 | Signal A2 |
|---|---|---|
| Line n | 0 | 0 |
| Line n + 1 | 0 | 1 |
| Line n + 2 | 1 | 0 |
| Line n + 3 | 1 | 1 |

Therefore, the circuit sections 26A to 26P receive line information indicating which scanning electrode Y corresponds to the lines n to n+3. Based on the signals A1 and A2 which are line information and the above-described signals FR1 and FR2, each of the circuit sections 26A to 26P controls the voltage level to be output to the display electrodes (lines n to n+3) in the selection period t1.

Specifically, in the case of the entire screen driving, as shown in Table 1, since all the scanning electrodes Y1, Y2, . . . Ym are assigned to one of the lines n to n+3, respectively, the driving control circuit 5 supplies line information corresponding to all the scanning electrodes Y1, Y2, . . . Ym to the circuit sections 26A to 26P. Then, as described above, based on the line information and the signals FR1 and FR2, in the selection period t1, each of the circuit sections 26A to 26P controls the voltage level to be output to all the scanning electrodes Y1, Y2, . . . Ym (lines n to n+3), for example, in accordance with the rules in Table 2.

Figure 5:
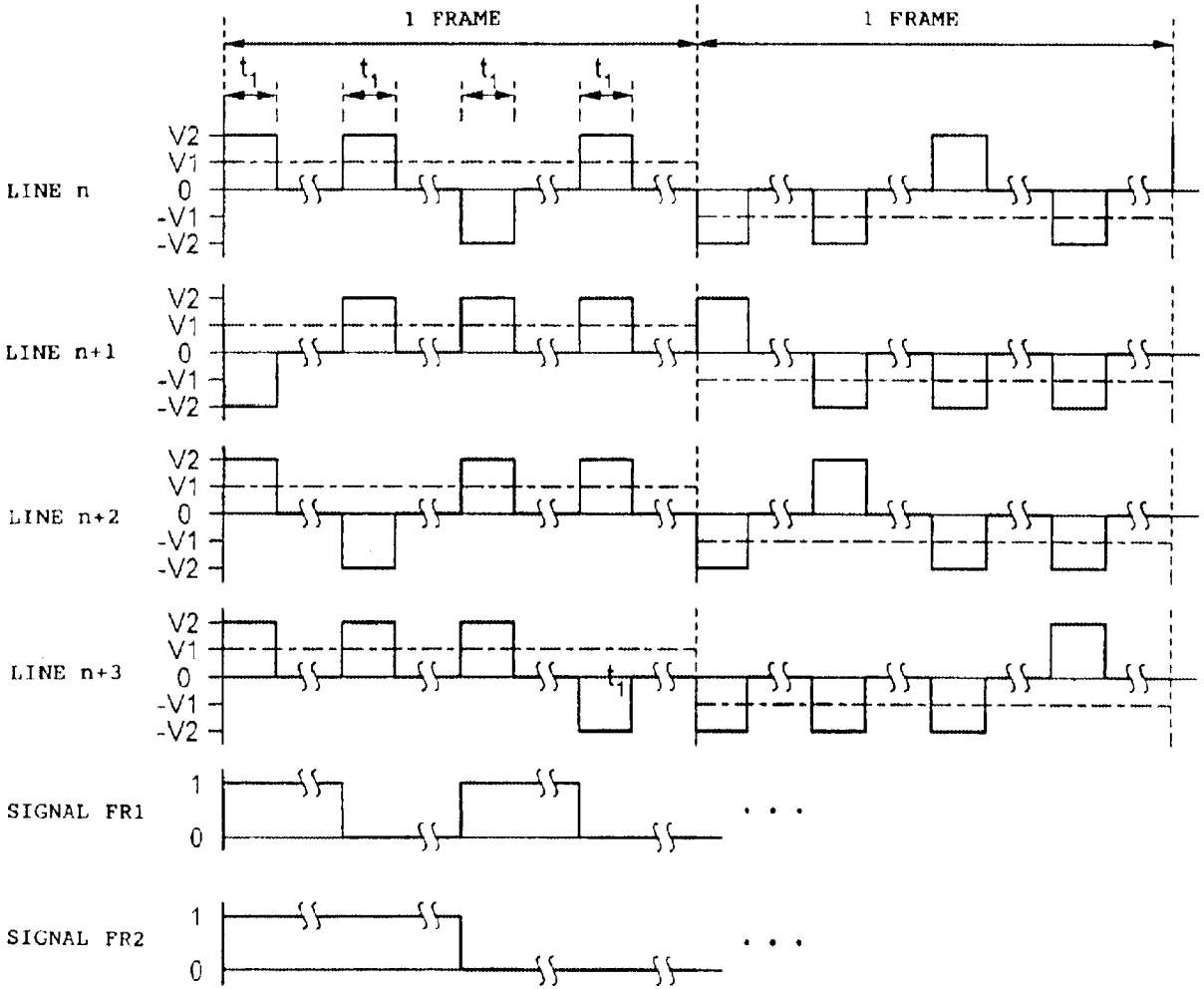
FIG. 5 is a diagram showing waveforms of scanning signals supplied to scanning electrodes when the liquid-crystal display panel in FIG. 1 is driven partially.

On the other hand, in the case of the partial driving, based on the line information and the signals FR1 and FR2, in the selection period t1, each of the circuit sections 26A to 26P controls the voltage level to be output to some of the display electrodes (lines n to n+3). However, also in the partial driving, control of the voltage level can be performed in accordance with rules similar to that for the entire screen driving, for example, the rules shown in Table 2. FIG. 5 shows examples of outputs of scanning signals in a case where some of the scanning electrodes Y are set as display electrodes (in the case of the partial driving). Since the lines n to n+3 are driven in accordance with the same rules shown in Table 2, the sequence of the rise and fall of the voltage is the same in FIGS. 3 and 5.

However, in the partial driving, since only some of the scanning electrodes Y1, Y2, . . . Ym are driven, the driving frequency of the display electrodes can be decreased in comparison with that for the entire screen driving, making it possible to reduce power consumption. This will next be described specifically.

For example, in this embodiment, the frame frequency is fixed to 40 Hz, that is, the period of one frame is fixed to 25 milliseconds. Herein, a frame is the period required to scan one display area of the liquid-crystal display panel 2 once, that is, the period required to drive all the display electrodes once. In this embodiment, since four scanning electrodes Y are driven at one time, in order that 64 electrodes Y be driven four times (there are four selection periods t1 in one frame) due to the entire screen driving, the duty cycle becomes $1/64$, and the span of one selection period t1 becomes $25/64=0.39$ milliseconds.

On the other hand, for example, suppose partial driving in which 16 electrodes Y are assigned as display electrodes. In this embodiment, since four scanning electrodes Y are driven at one time, in order to drive 16 display electrodes four times, the duty cycle becomes $1/16$, and the span of one selection period t1 becomes $25/16=1.56$ milliseconds. In this manner, the frequency of voltage changes can be reduced. The change of the duty cycle that determines the span of the selection period t1 can be performed by the calculation by the driving control circuit 5, for example, on the basis of display data and control data.

Referring to FIG. 7, various modes of displays according to this embodiment will now be described. The column (a) of FIG. 7 shows a case in which 8 lines are displayed by being divided into two rows. Specifically, as a result of a command signal indicating "1" being input to registers REG3 to REG6 and registers REG11 to REG14, scanning electrodes Y3 to Y6 and scanning electrodes Y11 to Y14 are set as display electrodes. The scanning electrodes Y3 to Y6 are driven in such a manner as to correspond to the lines n to n+3, respectively, and the scanning electrodes Y11 to Y14 are driven in such a manner as to correspond to the lines n to n+3, respectively. In this embodiment, since four scanning electrodes Y are driven at one time, in order to drive eight display electrodes four times, the duty cycle becomes $1/8$. Although FIG. 7 shows only the registers REG1 to REG16 for the sake of simplicity, a larger number of registers may be provided in practice.

The column (b) of FIG. 7 shows a case in which 16 lines are shown without being divided. The duty cycle in this case is 1/16.

The column (c) of FIG. 7 shows a case in which eight lines are displayed in one row without being divided. Specifically, as a result of a command signal indicating "1" being input to registers REG5 to REG12, continuous scanning electrodes Y5 to Y12 are set as display electrodes. The scanning electrodes Y5 to Y8 are driven in such a manner as to correspond to the lines n to n+3, respectively, and the scanning electrodes Y9 to Y12 are driven in such a manner as to correspond to the lines n to n+3, respectively. Also in this case, the duty cycle becomes 1/8.

Figure 8A:
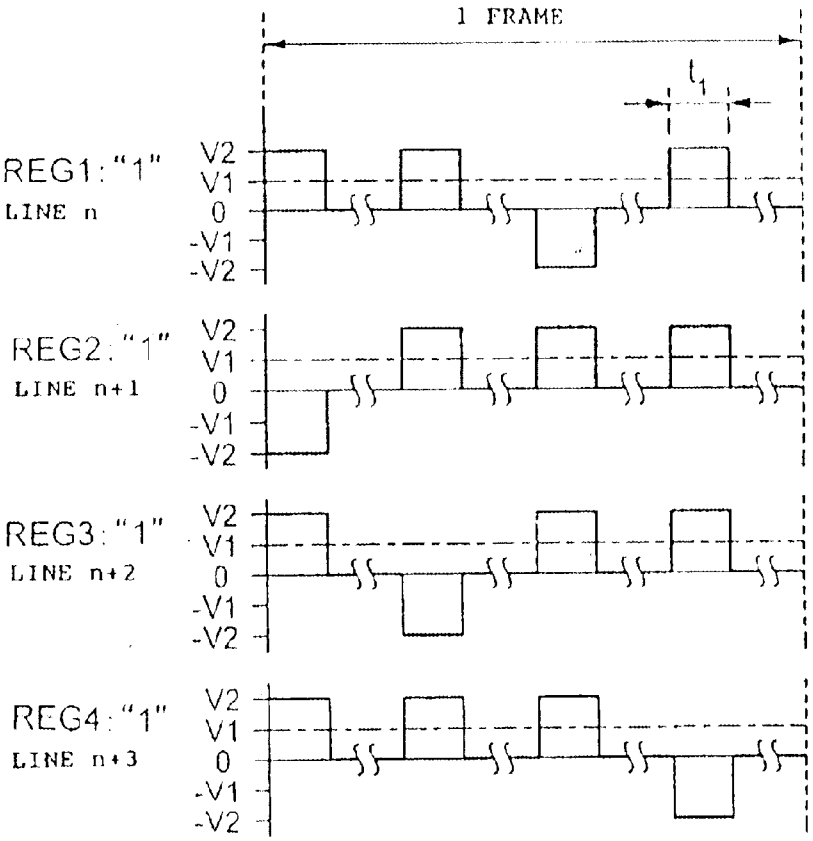
FIG. 8A is a diagram showing waveforms of scanning signals supplied to scanning electrodes when the liquid-crystal display panel in FIG. 1 is driven for the entire screen.
Figure 8B:
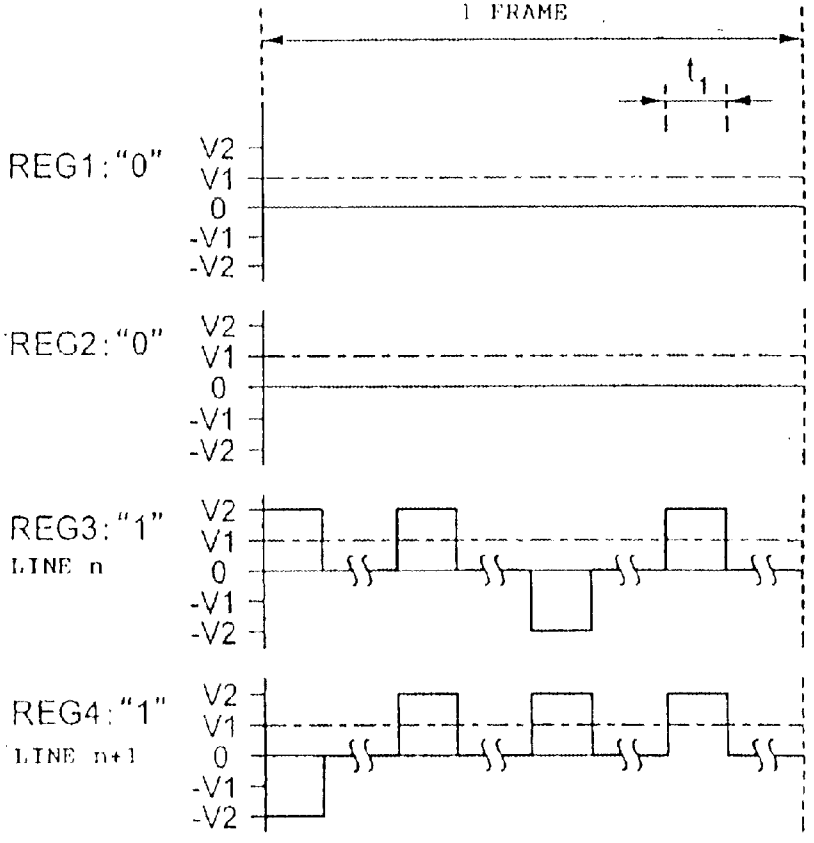
FIG. 8B is a diagram showing waveforms of scanning signals supplied to scanning electrodes when the liquid-crystal display panel in FIG. 1 is driven partially.

A description is given again of a scanning signal output to a scanning electrode Y when a command signal indicating "1" or "0" is input to each register REG. As shown in FIG. 8A, when a command signal indicating "1" is input to all the registers REG1 to REG4, the scanning electrodes Y1 to Y4 are driven simultaneously. On the other hand, as shown in FIG. 8B, in a case where "0" is written into the registers REG1 and REG2 and "1" is written into the registers REG3 and REG4, the signals corresponding to the registers REG1 and REG2 reach a zero potential, an output of a signal to the scanning electrodes Y1 and Y2 is stopped substantially, and only the scanning electrodes Y3 and Y4 corresponding to the registers REG3 and REG4 are driven. At this time, the scanning electrodes Y3 and Y4 corresponding to the registers REG3 and REG4 into which "1" is written are assigned lines n, n+1, . . . in sequence from the top side. Although FIG. 8 shows only the registers REG1 to REG4 for the sake of simplicity, a larger number of registers is provided in practice.

As is clear from the foregoing description, in the liquid-crystal display device 1 according to this embodiment, since the signal selection circuit 8 comprising plural registers REG1 to REG64 for regulating an output of a scanning signal is provided in the driving circuit 6 on the scanning side, it is possible to diversify displays on the screen of the liquid-crystal display panel 2 irrespective of the grouping of the scanning electrodes Y. Specifically, as is clear from Table 3 and FIG. 7, the widths of display areas and non-display areas can be changed as desired without being limited to the number of scanning electrodes Y which are driven simultaneously. That is, the widths of display areas and non-display areas can be selected independently of the multiple of the number of scanning electrodes Y which are driven simultaneously. Furthermore, a variety of multi-row displays such as those shown in FIGS. 6 and 7 are possible.

In addition, in this embodiment, by supplying line information to the circuit sections 26A to 26P, also in the partial driving, the voltage level can be controlled in accordance with the same rules (refer to FIG. 2) as those in the case of the entire screen driving. Furthermore, when the command signal which is input to the registers REG1 to REG64 is "0", since the scanning signal is not output to the scanning electrodes Y, power consumption of the non-display areas can be reduced.

In this embodiment, furthermore, as described below, the screen scrolling of the liquid-crystal display panel 2 can also be performed.

FIG. 9 shows an example of a screen scrolling pattern which can be realized by the liquid-crystal display device 1 according to this embodiment. This scrolling pattern is used in partial driving in which display areas in two rows are provided. That is, on the screen of the liquid-crystal display panel 2, whereas a display area which is realized by eight scanning electrodes Y is provided in the upper row, also in the lower row, a display area which is realized by 8 scanning electrodes Y as in the upper row is provided.

Specifically, in a first step, whereas the contents of the registers REG1 to REG8 and the registers REG17 to REG24 are set to "1", the contents of the other registers REG are maintained at "0". As a result, the scanning electrodes Y1 to Y8 and the scanning electrodes Y17 to Y24 become display electrodes, and display areas in two rows are provided.

In the next step, the contents of only the registers REG2 to REG9 and the registers REG18 to REG25 are set to "1". As a result, the registers REG2 to REG9 and the registers REG18 to REG25 become display electrodes, and display areas of the two rows are moved downward together. Hereafter, regarding the display area at the upper row, the registers REG into which the content "1" is input are changed regularly, such as the registers REG3 to REG10 being set to "1" and then the registers REG4 to REG11 being set to "1". Also regarding the display area at the lower row, the registers REG into which the content "1" is input are changed regularly, such as the registers REG19 to REG26 being set to "1" and then the registers REG20 to REG27 being set to "1". In this manner, the display areas in two rows move downward regularly and synchronously.

In order to realize screen scrolling, the driving control circuit 5 supplies a command signal periodically to registers REG in order to update the contents thereof. Each time such a command signal is supplied to the registers REG, the driving control circuit 5 supplies the signals A1 and A2 as line information indicating which scanning electrode Y corresponds to the lines n to n+3 to all the circuit sections 26A to 26P, so that the relative relationships between each scanning electrode Y and the lines n to n+3 are updated. Although FIG. 9 shows only the registers REG1 to REG32 for the sake of simplicity, a larger number of registers may be provided in practice.

FIG. 10 shows another example of a screen scrolling pattern which can be realized by the liquid-crystal display device 1 according to this embodiment. In this scrolling pattern, regarding the display area at the lower row, the registers REG into which "1" is input are changed regularly, such as at the first step, the contents of the registers REG17 to REG24 being set to "1", at the next step, the contents of the registers REG18 to REG25 being set to "1", furthermore, the registers REG19 to REG26 being set to "1", and next, the registers REG20 to REG27 being set to "1". However, regarding the display area at the upper row, from the first step, the contents of the registers REG1 to REG8 are maintained at "1". Therefore, while the display area at the upper row is fixed, only the display area at the lower row is scrolled. As described above, according to this embodiment, screen scrolling can also be realized easily, and furthermore, a variety of scrolling modes can be achieved.

In addition, by alternately writing the content "1" and "0" into each register and by appropriately changing the duty cycle for setting the selection period t1, it is also possible to cause the display in each line to blink.

Figure 11:
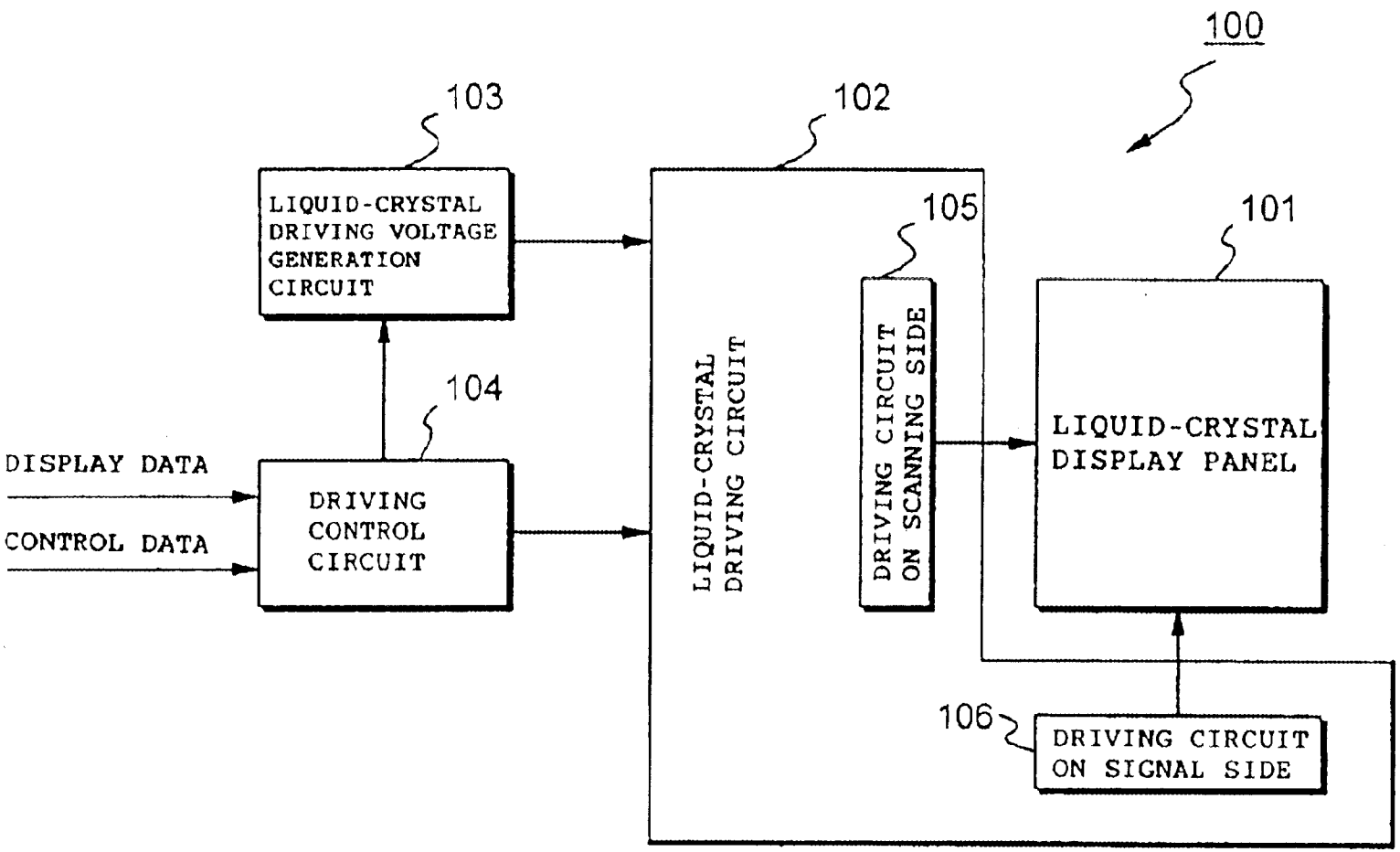
FIG. 11 PRIOR ART
FIG. 11 is a block diagram showing the entire construction of a liquid-crystal display device according to the conventional art.
Figure 12:
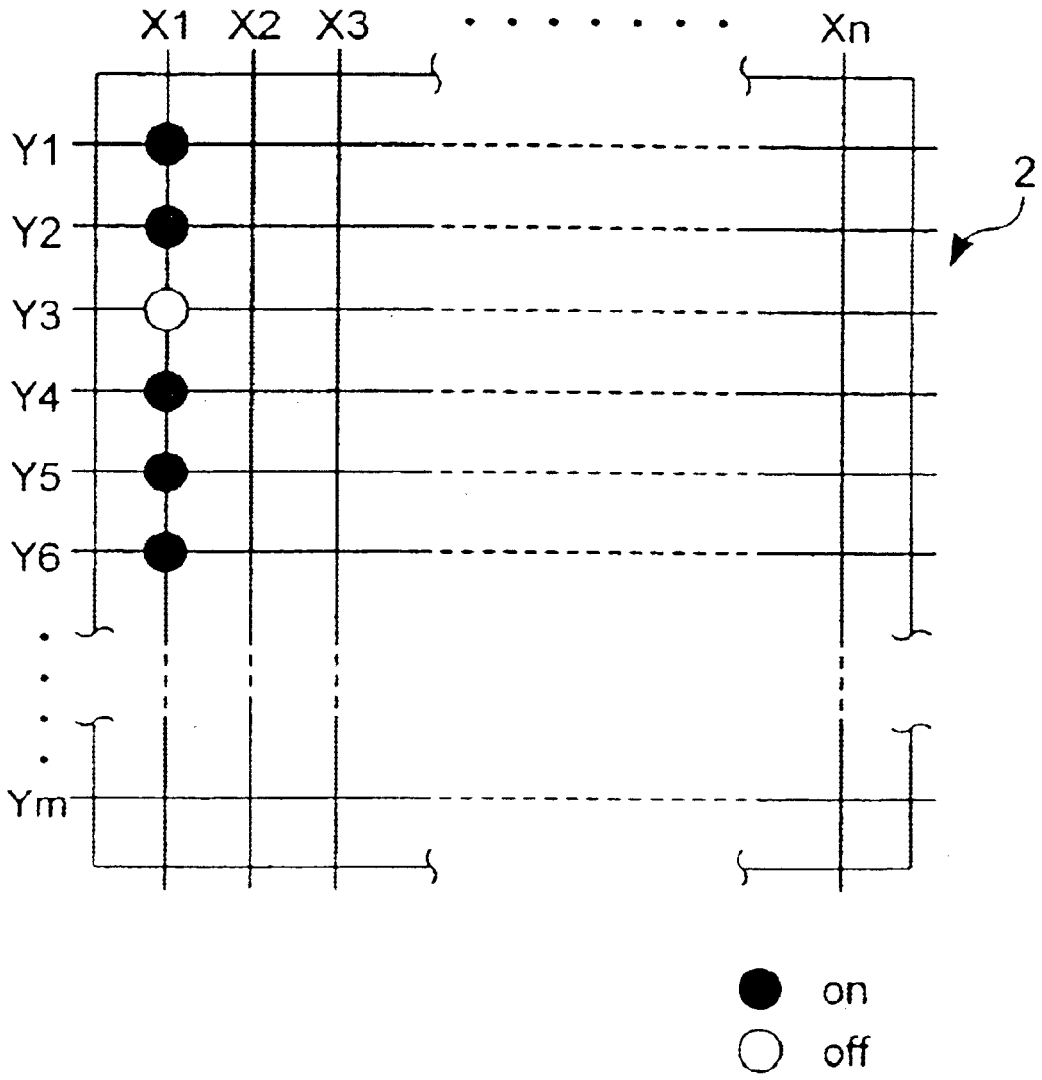
FIG. 12 PRIOR ART
FIG. 12 is a plan view showing a liquid-crystal display panel of the liquid-crystal display device in FIG. 11.
Figure 13:
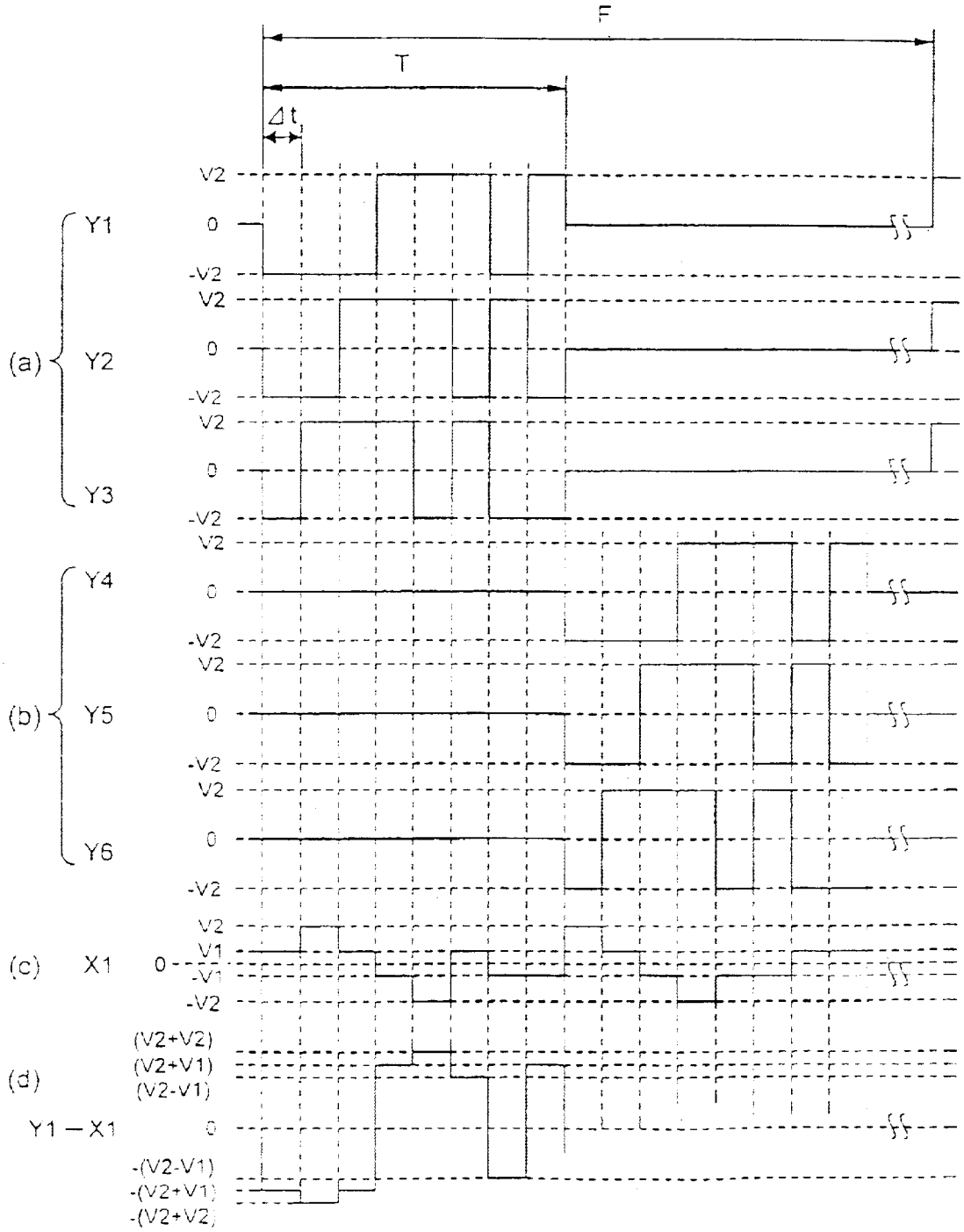
FIG. 13 PRIOR ART
FIG. 13 is a diagram showing waveforms of scanning signals and data signals applied to the liquid-crystal display panel in FIG. 11.

The embodiment of the present invention has thus been described. The principles used in this embodiment can also be applied to the liquid-crystal display device 100 according to the conventional art described with reference to FIGS. 11 to 13. As a result, also in the liquid-crystal display device 100, display areas and non-display areas can be set and screen scrolling can be realized irrespective of the grouping of the scanning electrodes Y. Modifications of such a liquid-crystal display device 1 are within the scope of the present invention.

What is claimed is:

1. A liquid crystal display device, comprising:

a liquid crystal display panel including a first substrate having a plurality of groups of scanning electrodes, each group containing at least two scanning electrodes, a second substrate having a plurality of signal electrodes, and a liquid-crystal layer interposed between the first and second substrates;

a control circuit that outputs command signals comprising a plurality of commands, one for each scanning electrode, indicative of which scanning electrodes are to be activated, outputs line information signals that respectively assign each of the to-be-activated scanning electrodes to a particular one of a plurality of scanning electrode lines, and outputs pulse control signals indicative of pulses to be applied to the scanning electrode lines during a particular time period;

a scanning signal circuit that outputs a first group of scanning signals at substantially the same time during one time period to a first set of scanning electrodes, each of which is assigned to a different one of the scanning electrode lines, and outputs a second group of scanning signals at substantially the same time during another time period to a second set of scanning electrodes, each of which is assigned to a different one of the scanning electrode lines, in response to the command, line information and pulse control signals output by the control circuit;

a data signal circuit that outputs data signals to the signal electrodes;

a signal selection circuit having a plurality of registers, one for each scanning electrode, wherein each register receives and stores a corresponding command indicating whether or not the corresponding scanning electrode is to be activated; and a scroll circuit that controls the setting of the commands stored in the registers so that the scanning electrodes are selectively activated as time elapses to generated a screen scrolling pattern;

wherein the scanning electrodes are selectively controlled and activated to generate one of plurality of display patterns during a particular time period irrespective of the grouping of the scanning electrodes.

2. A liquid crystal display device, comprising:

a liquid crystal display panel including a first substrate having a plurality of groups of scanning electrodes, each group containing at least two scanning electrodes, a second substrate having a plurality of signal electrodes, and a liquid-crystal layer interposed between the first and second substrates;

a control circuit that outputs command signals comprising a plurality of commands, one for each scanning electrode, indicative of which scanning electrodes are to be activated, outputs line information signals that respectively assign each of the to-be-activated scanning electrodes to a particular one of a plurality of scanning electrode lines, and outputs pulse control signals indicative of pulses to be applied to the scanning electrode lines during a particular time period;

a scanning signal circuit that outputs a first group of scanning signals at substantially the same time during one time period to a first set of scanning electrodes, each of which is assigned to a different one of the scanning electrode lines, and outputs a second group of scanning signals at substantially the same time during another time period to a second set of scanning electrodes, each of which is assigned to a different one of the scanning electrode lines, in response to the command, line information and pulse control signals output by the control circuit;

a data signal circuit that outputs data signals to the signal electrodes; and a signal selection circuit having a plurality of registers, one for each scanning electrode, wherein each register receives and stores a corresponding command indicating whether or not the corresponding scanning electrode is to be activated;

wherein the scanning electrodes are selectively controlled and activated to generate one of plurality of display patterns during a particular time period irrespective of the grouping of the scanning electrodes; and wherein the scanning signal circuit and the signal selection circuit are embodied as a single circuit.

* * * * *